US011034565B2

(12) United States Patent
Running

(10) Patent No.: US 11,034,565 B2
(45) Date of Patent: Jun. 15, 2021

(54) REVOLVING PAPER ROLL CLAMP WITH SHORT ARM DRIFT PREVENTION

(71) Applicant: Cascade Corporation, Fairview, OR (US)

(72) Inventor: Brent G. Running, Hood River, OR (US)

(73) Assignee: Cascade Corporation, Fairview, OR (US)

( * ) Notice: Subject to any disclaimer, the term of this patent is extended or adjusted under 35 U.S.C. 154(b) by 45 days.

(21) Appl. No.: 16/292,754

(22) Filed: Mar. 5, 2019

(65) Prior Publication Data

US 2020/0283278 A1 Sep. 10, 2020

(51) Int. Cl.
*B66F 9/18* (2006.01)

(52) U.S. Cl.
CPC ..... *B66F 9/184* (2013.01)

(58) Field of Classification Search
CPC ..... F15B 11/161; F15B 11/166; F15B 2211/30585; F15B 2211/50518; F15B 2211/782; F15B 2211/7142; F15B 2211/3059; F15B 2211/76; F15B 2211/528; F15B 2211/3116; F15B 2211/3051; F15B 2211/575; F15B 2211/67; F15B 2211/40523; F15B 2211/40; F15B 2211/30595; F15B 2211/55; F15B 2211/555; F15B 2211/565; B66F 9/146; B66F 9/183; B66F 9/22; B66F 9/18; B66F 9/184; B66F 9/20; B25J 15/04; B25J 13/08; B66C 1/42; B66C 1/62; B66C 1/00; G01D 7/00; G01G 19/10
See application file for complete search history.

(56) References Cited

U.S. PATENT DOCUMENTS

| | | | | |
|---|---|---|---|---|
| 4,127,205 | A | 11/1978 | Farmer et al. | |
| 4,177,000 | A | 12/1979 | Weinert et al. | |
| 4,435,119 | A | 3/1984 | House | |
| 4,742,468 | A * | 5/1988 | Ohashi | B66F 9/184 414/273 |
| 5,417,464 | A | 5/1995 | Seaberg et al. | |
| 5,536,133 | A | 7/1996 | Velez et al. | |
| 5,984,617 | A | 11/1999 | Seaberg | |
| 6,027,302 | A * | 2/2000 | Nilsson | B66F 9/184 294/206 |

(Continued)

OTHER PUBLICATIONS

United States Patent and Trademark Office; International Search Report and Written Opinion for Int'l App. No. PCT/US2020/016860 dated Apr. 30, 2020; 6 pages.

*Primary Examiner* — Stephen A Vu
(74) *Attorney, Agent, or Firm* — Chernoff, Vilhauer, McClung & Stenzel, LLP

(57) ABSTRACT

A load-handling clamp mountable on a lift truck is capable of clamping a load between respective opposed clamp arms each capable of hydraulic movement selectively toward or away from each other. One of the clamp arms is preferably substantially incapable of movement toward the other clamp arm unless actuated independently of the other clamp arm. One of the clamp arms also preferably has a lesser maximum range of hydraulic movement than the other of the clamp arms and is hydraulically movable at a maximum hydraulic pressure greater than that of the other clamp arm.

5 Claims, 1 Drawing Sheet

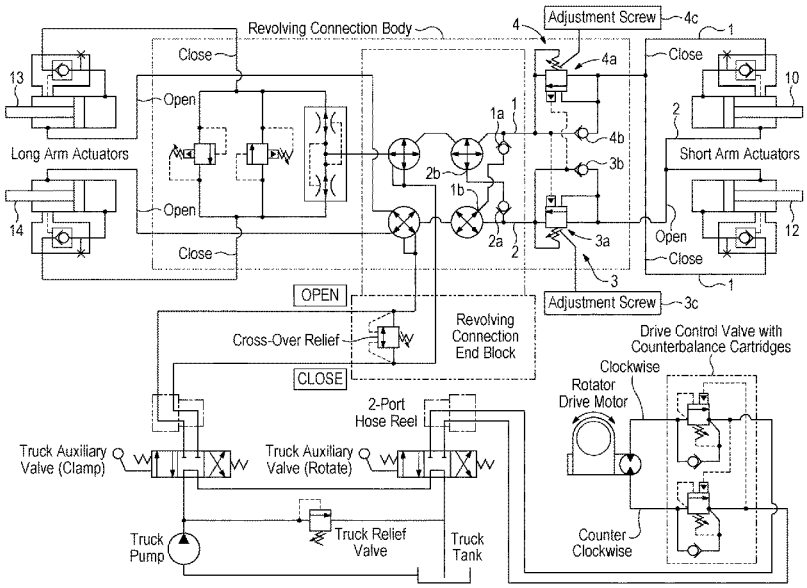

(56) References Cited

U.S. PATENT DOCUMENTS

| | | | | |
|---|---|---|---|---|
| 6,843,636 | B2 * | 1/2005 | Jordan | B25J 13/082 414/21 |
| 2005/0104397 | A1 | 5/2005 | Jordan et al. | |
| 2007/0065271 | A1 † | 3/2007 | Merin | |
| 2017/0283228 | A1 | 10/2017 | Running | |
| 2018/0252572 | A1 | 9/2018 | Petronek | |

* cited by examiner
† cited by third party

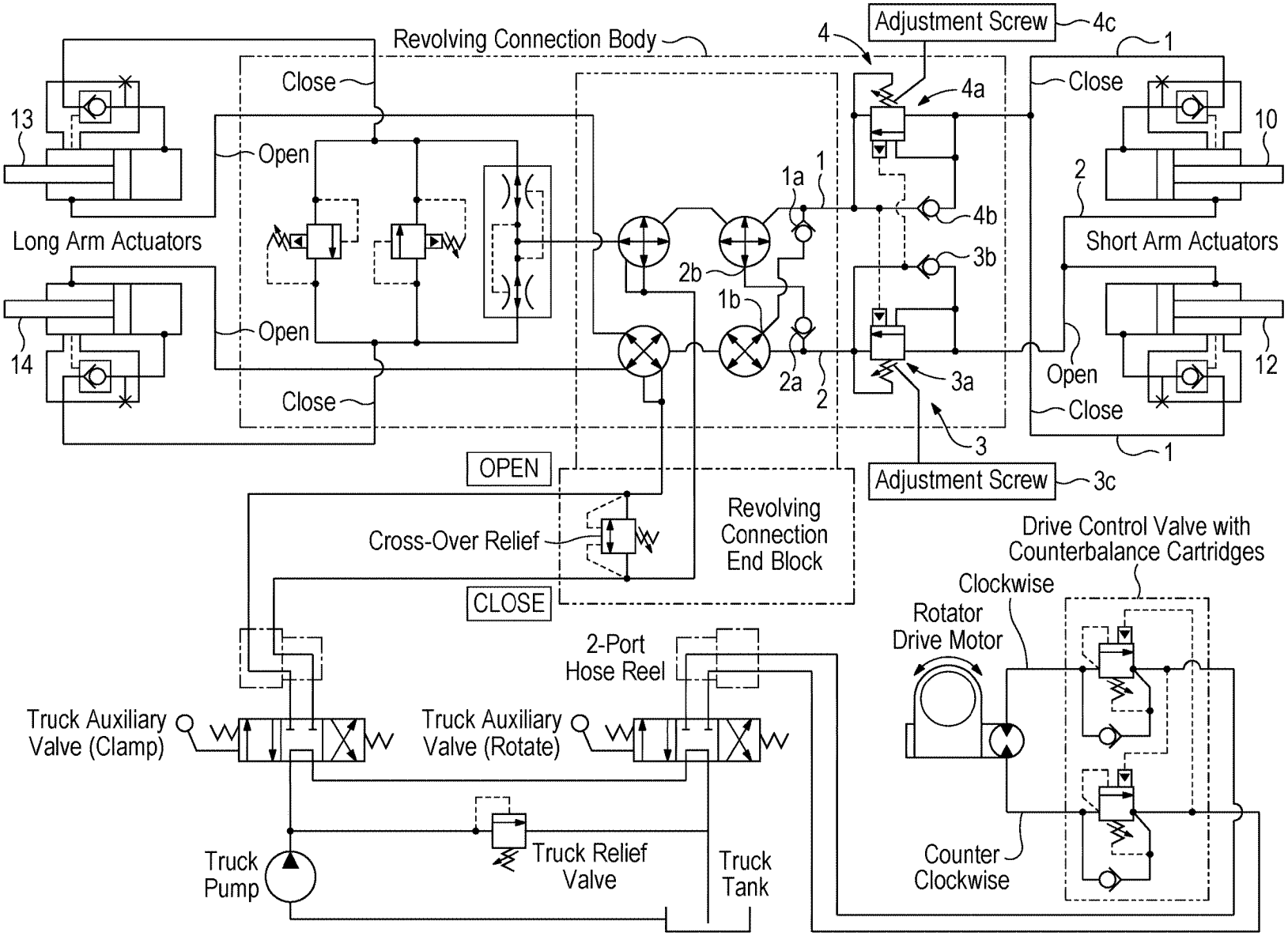
Short Arm Actuators
Long Arm Actuators
Adjustment Screw
Adjustment Screw
Close
Open
Close
Open
Close
Open
Close
Revolving Connection Body
Revolving Connection End Block
Cross-Over Relief
OPEN
CLOSE
Drive Control Valve with Counterbalance Cartridges
Clockwise
Counter Clockwise
Rotator Drive Motor
2-Port Hose Reel
Truck Auxiliary Valve (Rotate)
Truck Auxiliary Valve (Clamp)
Truck Relief Valve
Truck Tank
Truck Pump
1
2
3
3a
3b
3c
4
4a
4b
4c
1a
1b
2a
2b
10
12
13
14

REVOLVING PAPER ROLL CLAMP WITH SHORT ARM DRIFT PREVENTION

BACKGROUND OF THE INVENTION

Paper mills commonly output bulk paper from paper-making machines by winding paper in a continuous sheet around a core. The resultant cylindrical bulk paper loads, which vary widely in diameter, mass, and density, are subsequently converted into final products by so called Converters. Between the foregoing paper-making machine output, and the conversion into such final products, the bulk paper is transported and manipulated. Such transportation and manipulation generally require means for "handling" a paper "roll" or "reel" by physical engagement thereof. For example, such handling often involves the use of a lift truck which has a load-handling attachment, known interchangeably as a Paper Roll Clamp or Paper Reel Clamp, and referred to hereafter collectively as a "PRC". The PRC selectively clamps or unclamps paper rolls for transport by a lift truck or other transport means. While the paper roll is clamped, the PRC can usually enable selective hoisting, tilting and/or transporting of the clamped roll, and can also selectively rotate the clamped roll about an axis. Common general types of PRC are exemplified, without limitation, by U.S. Pat. Nos. 4,435,119 and 5,984,617. Alternatively, other forms of clamps could handle such paper rolls, and are not intended to be excluded herein.

PRCs typically use respective "long" and "short" opposed clamp arms. Prior to application of clamp force, the operator normally enables a PRC to approach a paper roll and position the short arm adjacent to the roll so that it is ready to oppose the clamping force to be applied by the long arm. Thereafter, the long arm is powered to oppositely engage the load with sufficient load-holding force to securely clamp the load between the opposed long and short arms. While the long arm is moving or applying clamping force to the roll, the short arm preferably remains stationary, but could be further adjusted if necessary.

Some applications do not require powering the short clamp arm and, if so, a "fixed" permanently stationary short arm would be suitable. However, most applications require both the long arm and the short arm to be adjustably positionable. Therefore, both the long arm and the short arm are normally selectively powered hydraulically in both clamp-closing and clamp-opening directions.

A small amount of internal hydraulic fluid leakage from the long arm to the short arm, during repeated opening and closing of the long arm, tends to close the maximum separation between the long arm and the short arm, and has usually been found in practice to be inevitable unless the long arm and the short arm are hydraulically isolated from each other by extra hydraulic valves and conduits whose additional volume, weight and cost discourage such use in a lift truck. Because the long arm is the arm that is normally powered in the standard load clamping process, such leakage usually originates at long arm hydraulic ports and leaks toward short arm hydraulic ports in the clamping system. This leakage manifests itself by closing the short arm uncontrollably toward the long arm during successive load clamping events, resulting in unintended cumulative short arm closing movements commonly referred to as "short arm drift." Short arm drift is a major nuisance to lift truck operators, and a serious disadvantage to lift truck productivity, because the foregoing leakage necessitates time-consuming periodic corrections of short arm positions by requiring temporary release of loads to reopen a short arm back to its intended operational load-engaging position.

The foregoing problem is amplified by the fact that end users most often handle rolls equivalent or very close to the maximum load diameter for the clamp they are operating. Therefore, after a relatively short period of operation where the short arm has been subject to the leakage described above, and has thereby drifted toward the opposing clamp arm, the maximum available clamp opening between the long arm and short arm is no longer sufficient to span the intended loads. Therefore, the operator must interrupt the load-handling operation and reposition the short arm outwardly to again enable the clamp arms to engage the loads. Such a necessity, requiring the operator to repeatedly reposition the short arm in the middle of a high-volume production operation, can be a significant problem, especially when a lift-truck mounted clamp is likely to be operating within tight space constraints such as stacks of closely spaced rolls in a warehouse, or inside a rail car or highway trailer. Economically minimizing such a repetitive and production-limiting problem is the principal purpose of the present invention.

SUMMARY OF THE INVENTION

The present invention is a load-handling clamp which significantly reduces the extent and frequency of the foregoing "short-arm drift" problems which otherwise cause unexpected interruptions of industrial load-handling hydraulic clamps during normal clamp usage, as described above.

The foregoing and other objectives and features of the invention will be more readily understood upon consideration of the following detailed description of the invention taken in conjunction with the accompanying drawing.

BRIEF DESCRIPTION OF THE DRAWING

The single drawing is a hydraulic circuit diagram incorporating exemplary embodiments of the foregoing invention.

DETAILED DESCRIPTION OF PREFERRED EMBODIMENTS

Embodiment 1

With reference to the foregoing drawing, the present invention is intended to substantially prevent, or at least significantly limit, uncontrolled "short arm drift" which commonly results in unintended premature lift truck load clamp closures by one or more "short arm" clamping actuators such as 10 and 12, toward opposing "long arm" clamping actuators such as 13 and 14, during successive clampings of large paper rolls or other comparable loads.

As shown in the foregoing drawing, a preferred embodiment of the invention has hydraulic flow paths 1 which can selectively extend short arm clamping actuators 10 and 12, and also opposing hydraulic flow paths 2 which can selectively retract the same short arm actuators 10 and 12. These flow paths can selectively clamp or unclamp a load hydraulically, pursuant to control of the short arm actuators 10 and 12, by controlling hydraulic flow which can potentially result in undesirable short arm leakage known as "short arm drift," which is diverted from hydraulic lines 1 or 2 respectively through respective check valves such as 1*a* or 2*a* to intended leakage points 1*b* or 2*b* and, if desired, to additional leakage points.

Embodiment 2

However, if "short arm drift" problems persist, a hydraulic system which would otherwise result in short arm drift can utilize an alternative hydraulic circuit element which ensures that a flow path, which introduces fluid into short arm actuators such as 10 and 12, is not a flow path of least resistance and therefore can avoid the foregoing "short arm drift" problem. This is exemplified as follows:

(a) fluid which creates inward drift can be introduced into the "head side" of the short arm actuators and exhausted from the "rod side" of the short arm actuators. Inward drift is prevented by increasing the pressure necessary for exhausted fluid to be returned to the tank. The circuit element used to increase the pressure necessary to exhaust rod side fluid is counterbalance valve assembly 3. By default, the counterbalance valve assembly 3 is preferable set at 1000 psi but could be increased by an adjustment screw 3*c*. An exemplary component of valve assembly 3 which prevents fluid flow until driving pressure exceeds 1000 psi is labeled as item 3*a*. Fluid flow in the opposite direction is permitted by counterbalance valve 3*b;*

(b) alternatively, fluid which creates outward drift can be introduced into the "rod side" of the short arm cylinders and exhausted from the "head side" of the short arm cylinders. Outward drift is prevented by increasing the pressure necessary for exhausted fluid to be returned to tank. An exemplary valve assembly 4 which could be used to increase the pressure necessary to exhaust head side fluid has a counterbalance valve, indicated as Item 4*a*. By default, the counterbalance valve 4*a* is preferably set at 1000 psi but can be increased by turning an adjustment screw 4*c*. An exemplary component of circuit 4 which prevents flow until driving pressure exceeds 1000 psi is labeled as item 4*b*.

The foregoing circuit element as applied is adjustable in order to compensate for cases where other circuit realities impact the resistance inherent within the alternative flow path. The above-mentioned adjustment screw enables quick field adjustment capabilities. One such circuit element is necessary in cases where "inward" drift is experienced. Another equivalent circuit element could be employed in cases where "outward" drift is experienced.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A load handling clamp capable of clamping a load between respective opposed first and second clamp arms each of the first and second clamp arms is capable of hydraulic movement selectively toward or away from each other, the second clamp arm having a lesser maximum range of said hydraulic movement than the first clamp arm and being substantially incapable of movement toward the first clamp arm unless actuated independently of any actuation of the first clamp arm, wherein the second clamp arm is hydraulically movable only at a hydraulic pressure that is greater than hydraulic pressure used to move the first clamp arm, further comprising a counterbalance valve assembly that prevents hydraulic fluid flow to and from the second clamp arm unless the hydraulic fluid is at the hydraulic pressure that is greater than the hydraulic pressure used to move the first clamp arm, further comprising an adjustment screw to allow a user to set the hydraulic pressure for the counterbalance valve assembly to allow hydraulic flow to and from the second clamp arm.

2. A load handling clamp capable of clamping a load between respective opposed first and second clamp arms each of the first and second clamp arms is capable of hydraulic movement selectively toward or away from each other, the second clamp arm having a lesser maximum range of said hydraulic movement than the first clamp arm and being substantially incapable of movement toward the first clamp arm unless actuated independently of any actuation of the first clamp arm, wherein the second clamp arm is hydraulically movable only at a hydraulic pressure that is greater than hydraulic pressure used to move the first clamp arm, wherein the second clamp arm is shorter in length than the first clamp arm.

3. The load handling clamp of claim 2, further comprising a counterbalance valve assembly that prevents hydraulic fluid flow to and from the second clamp arm unless the hydraulic fluid is at the hydraulic pressure that is greater than the hydraulic pressure used to move the first clamp arm.

4. The load handling clamp of claim 3, further comprising an adjustment screw to allow a user to set the hydraulic pressure for the counterbalance valve assembly to allow hydraulic flow to and from the second clamp arm.

5. A load handling clamp capable of clamping a load between respective opposed first and second clamp arms each of the first and second clamp arms is capable of hydraulic movement selectively toward or away from each other, the second clamp arm having a lesser maximum range of said hydraulic movement than the first clamp arm and being substantially incapable of movement toward the first clamp arm unless actuated independently of any actuation of the first clamp arm, wherein the second clamp arm is hydraulically movable only at a hydraulic pressure that is greater than hydraulic pressure used to move the first clamp arm, further comprising a counterbalance valve assembly that prevents hydraulic fluid flow to and from the second clamp arm unless the hydraulic fluid is at the hydraulic pressure that is greater than the hydraulic pressure used to move the first clamp arm, further comprising an adjustment screw to allow a user to set the hydraulic pressure for the counterbalance valve assembly to allow hydraulic flow to and from the second clamp arm, wherein the second clamp arm is shorter in length than the first clamp arm.

* * * * *